United States Patent [19]

Kasuga

[11] 4,218,969

[45] Aug. 26, 1980

[54] BAND FEEDING AND TIGHTENING APPARATUS FOR STRAPPING MACHINE

[75] Inventor: Yoshiaki Kasuga, Yokohama, Japan

[73] Assignee: Nichiro Kogyo Company, Limited, Yokohama, Japan

[21] Appl. No.: 8,602

[22] Filed: Feb. 1, 1979

[51] Int. Cl.[2] ..... B65B 13/22

[52] U.S. Cl. ..... 100/32; 100/26; 100/33 PB

[58] Field of Search ..... 226/183, 195; 100/26, 100/33 PB, 29, 32

[56] References Cited

U.S. PATENT DOCUMENTS

| | | | |
|---|---|---|---|
| 3,269,300 | 8/1966 | Billett | 100/26 X |
| 3,566,778 | 3/1971 | Vilcins | 100/33 PB |
| 3,752,058 | 8/1973 | Lems | 100/32 |
| 3,759,169 | 9/1973 | Goodley | 100/32 |

FOREIGN PATENT DOCUMENTS

| | | | |
|---|---|---|---|
| 1191991 | 5/1970 | United Kingdom | 100/26 |

*Primary Examiner*—Billy J. Wilhite

*Attorney, Agent, or Firm*—Oblon, Fisher, Spivak, McClelland & Maier

[57] ABSTRACT

A strapping machine comprises a return roller having a high friction outer peripheral surface and a feed roller having a low friction outer peripheral surface which are contacted with each other under pressure and the return roller is disposed in free condition during the rotation of the feed roller in one direction and when the feeding resistance of the band is increased, the band is slipped on the outer peripheral surface of the feed roller to prevent the feeding of the band and in order to tighten the band around the package, both of the rollers are reversely rotated at a high speed to tighten the band around an object to be packed and then continuously rotated at a low speed to impart high torque to the band for an attainment of further tightening thereof.

2 Claims, 6 Drawing Figures

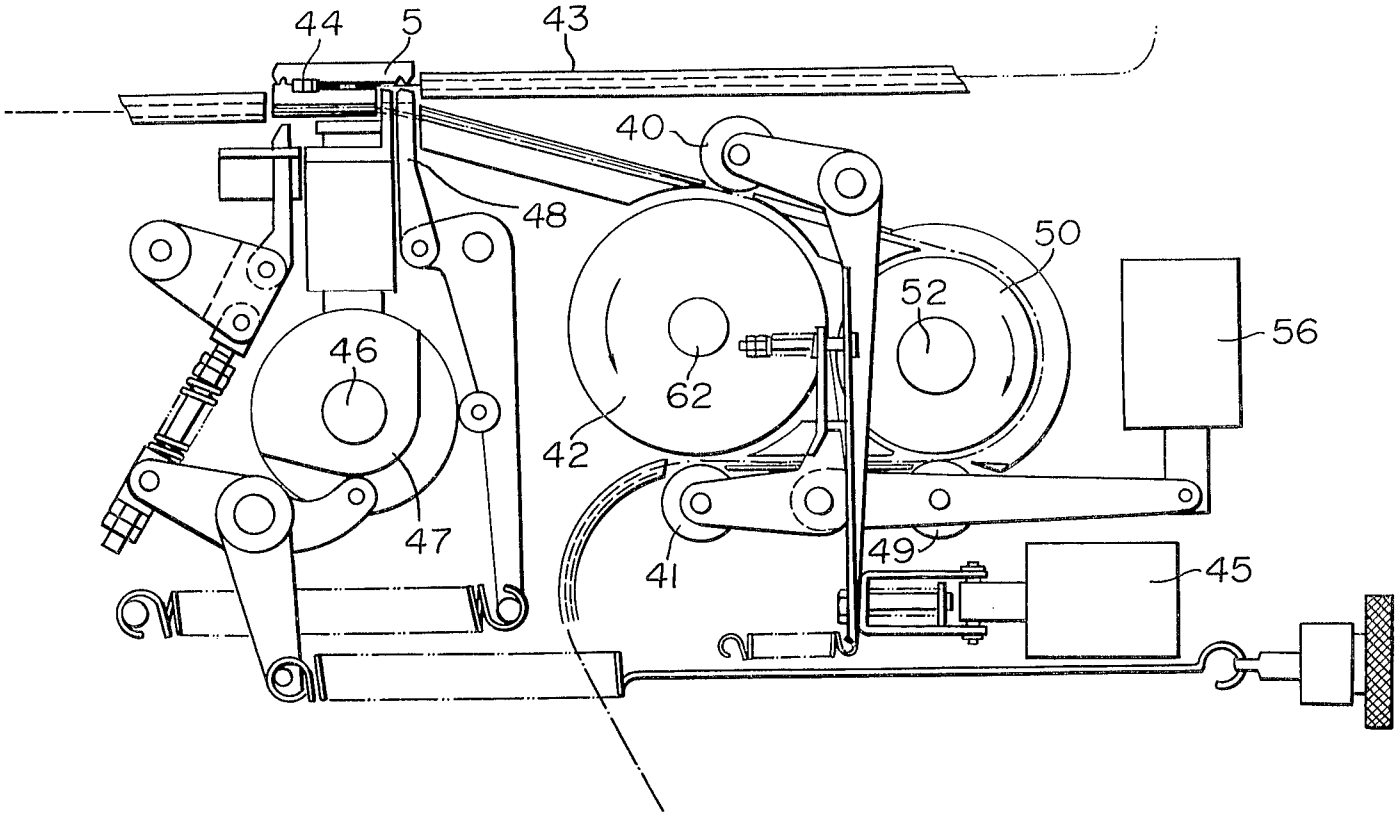
FIG. 5 *Prior Art*

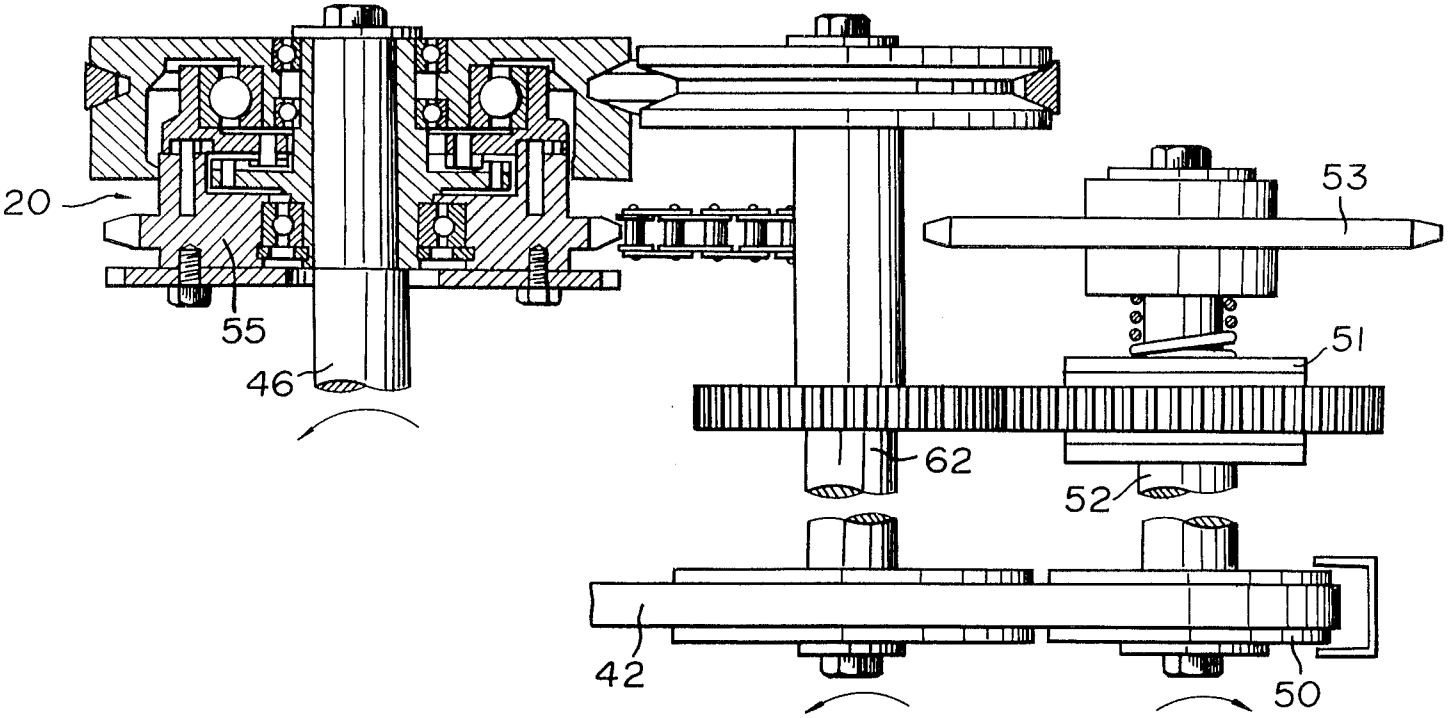
FIG. 6 *Prior Art*

BAND FEEDING AND TIGHTENING APPARATUS FOR STRAPPING MACHINE

BACKGROUND OF THE INVENTION

1. Field of the Invention

The present invention relates to a band feeding and tightening system in a strapping machine for automatically feeding a band to an arch guide and tightening the band guided in a looped condition along the arch guide around a package by using a return roller and a feed roller contacting each other.

2. Description of the Prior Art

As one of the conventional band feeding and tightening apparatus, it has been proposed to use an apparatus disclosed in Japanese Utility Model Publication No. 23280/1965, in which a return roller and a feed roller rotated at a high speed in the reverse direction of each other are disposed in spaced relation and rocker rollers are provided to selectively contact with the rollers respectively so as to feed the band at a high speed or to tighten the band and a tension lever is provided to impart strong tightening torque to the band. In Japanese Unexamined Publication No. 64396/1977 proposed as an improvement of the conventional apparatus, the tension lever is omitted.

The construction will be illustrated referring to FIGS. 5 and 6.

Rocker rollers (40) and (41) are contacted with a feed roller (42) under pressure and a band is fed into an arch guide (43). The free end of the band passing through the arch guide in looped shape is contacted with a limit switch actuator (44) under a slide table (5) to deenergize a solenoid (45) so as to disengage each rocker roller (40), (41) from the feed roller (42) whereby the feeding operation is completed. Then, a light gripper (48) is raised through a group of cams (47) by the rotation of a seal forming shaft (46) to grip the free end of the band with association of the slide table (5).

After this, the rocker roller (49) is contacted with the return roller (50) under pressure by energizing the solenoid (56) to pull the band back. When the tightening force is reached to a specific value the clutch begins to slip to decrease rapidly the revolution speed of the return shaft (52). When the revolution speed is lower than that of a sprocket (53), the rotation of the sprocket (53) which has not effected the function, is effectively transmitted to the return shaft (52) whereby the band is further tightened by the return roller (50) of the return shaft (52) depending upon low revolution speed under high torque which is imparted to the sprocket (55) of the differential reducing machine (20).

The other conventional apparatus for feeding and tightening the band by rotating a single roller in the positive or the reverse direction has been proposed. However, its rotation should be low in order to impart a strong tightening torque to the band for the attainment of the final tightening thereof. Therefore, it does not satisfy the demand in the field of the strapping machine which increasingly requires to shorten the time for strapping. In the conventional system, the band is often run over from the guide or is bent in the guide because the force applied to feeding the band by the rotation of the single roller is disadvantageously too great during the feeding operation.

SUMMARY OF THE INVENTION

An object of the invention is to provide a band feeding and tightening system which simplifies a structure and imparts stronger tightening force while functioning in the same way as that of the Japanese Unexamined Publication No. 64396/1977.

The foregoing and the other objects of the invention can be attained by the feeding and tightening method which comprises contacting under pressure a return roller having a high friction peripheral surface with a feed roller having a low friction peripheral surface; disposing the return roller in free condition during feeding the band to rotate the return roller depending upon the rotation of the feed roller having the low friction peripheral surface wherein the band is slipped on the peripheral surface of the feed roller when the feeding resistance of the band is increased so as to control the feeding automatically.

BRIEF DESCRIPTION OF THE DRAWINGS

Various objects, features and attendant advantages of the present invention will be fully appreciated as the same becomes better understood from the following detailed description of the invention when considered in connection with the accompanying drawings wherein the like reference numerals designate identical or corresponding parts throughout several views, in which:

FIG. 5 is a front view of the conventional strapping machine; and

FIG. 6 is a plan view of the important part of the conventional strapping machine.

DETAILED DESCRIPTION OF THE PREFERRED EMBODIMENT

Figure 1:
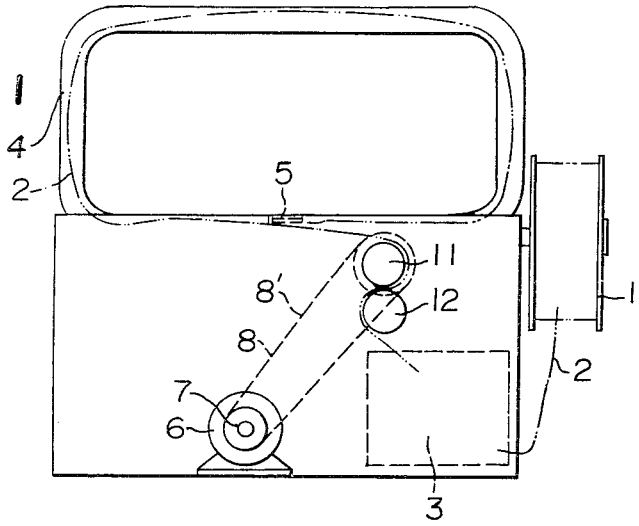
FIG. 1 is a schematic view of one embodiment of a strapping machine according to the present invention.

The reference numeral (1) designates a reel winding a plastic band thereon, (3) designates a chamber which temporarily stores certain length of the band to be fed into an arch guide (4), (5) designates a slidable table disposed on a sealing mechanism, (6) designates a reversible motor, and (7) designates a pulley which is connected through belts (8), (8') to a pulley (9) of a band feeding-tensioning device and a pulley (10) of a differential reducing machine (20), respectively.

Figure 2:
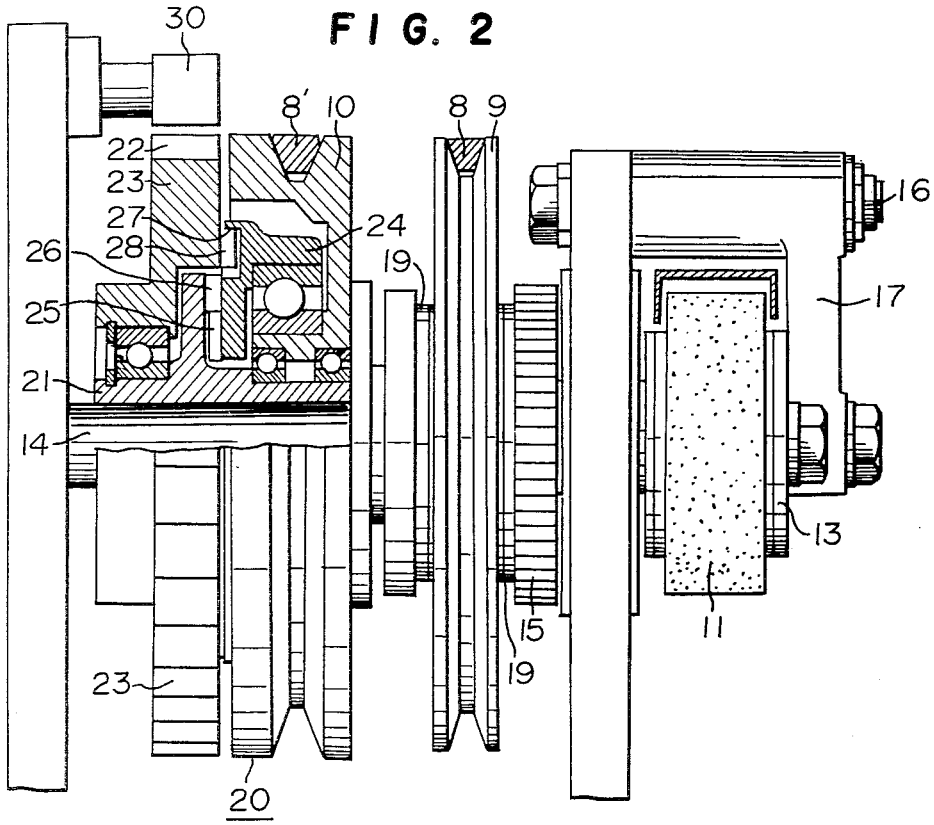
FIG. 2 is a plan view of a part of the strapping machine.
Figure 3:
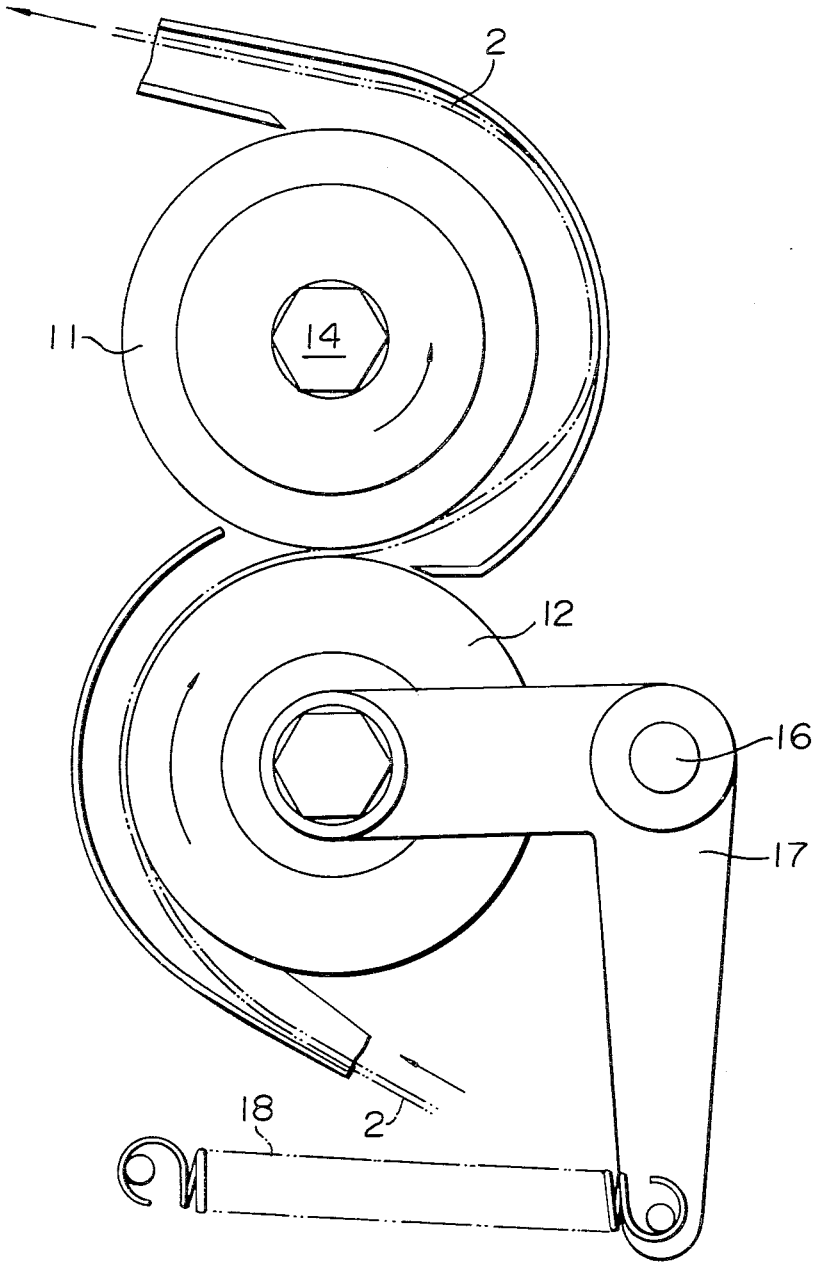
FIG. 3 is a front view of the feed roller and the return roller according to the invention.

The feeding-tensioning device comprises a return roller (11) having high friction and a feed roller (12) having relatively low friction and the return roller (11) is fitted through a one way clutch (13) to a shaft (14) such that when the shaft (14) is driven to the arrow direction in FIG. 3, the return roller is in free condition and when the shaft is driven to the reverse direction, the return roller is driven under engaging with the clutch. A gear (15) fitted to the shaft (14) is meshed with a gear (not shown) in one piece of the feed roller (12) to transmit the rotational torque to the feed roller (12). The feed roller (12) is connected to one end of a rocking member (17) supported by a bearing (16) and is contacted with the return roller (11) under pressure by the spring action of a spring (18) fixed at the other end, as shown in FIG. 3. That is, the feed roller (12) is contacted with the return roller under pressure and the gear integral with the feed roller (12) is interlocked with the gear (15) respectively, as shown in FIG. 2. When the shaft is forwardly rotated, the return roller (11) is in free condition to the feed roller (12) and the band (2) in the chamber (3) is fed to the arch guide (4) by the return roller (11) rotated depending upon the rotation of the feed roller (12). When the shaft (14) is reversely rotated, both of the rollers are driven to quickly pull back the band so as to tighten it around a package.

The pulley (9) is fixed through friction plates (19), (19') to the shaft (14) and the differential reducing machine (20) having the pulley (10) is also fixed to the shaft (14). The differential reducing machine comprises a base body (21) mounted on the shaft (14), the pulley (10) and a disc (23) having interlocking tooth at the outer peripheral surface which are freely fitted through bearings to the base body respectively, and an eccentric body (24) which is freely fitted to the pulley in eccentrical manner.

A plurality of engaging rolls (25) radially provided on the eccentric body (24) are engaged with a plurality of engaging rolls (26) provided on the base body (21) (FIG. 4) to dispose slidably the rolls (28) which slidably rotate in four of opening holes (27) formed in the eccentric body (24), in the disc (23).

A rocking member (30) having a stop tooth (29) engaged with the engaging gear (22) of the disc (23) has a pivoted base portion and a connecting rod (32) connected to a solenoid (31) at the extreme end.

Figure 4:
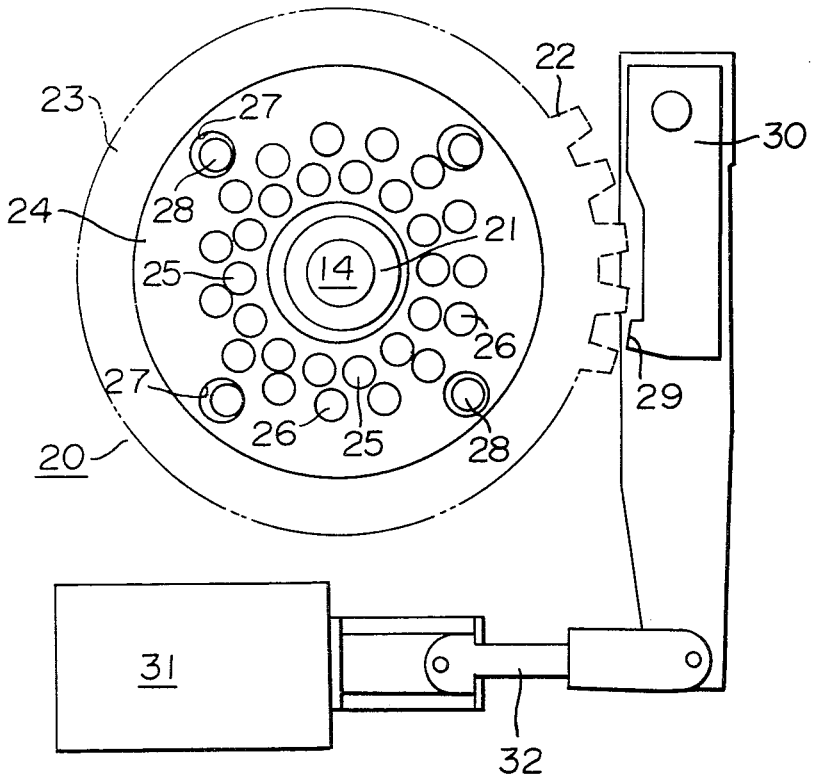
FIG. 4 is a front view of the differential reducing machine.

Thus, in order to feed the band, when the motor (6) is positively rotated to drive the pulleys (9) and (10) through the belts with the same angle spaced respectively, the shaft (14) is also rotated through the friction plate (19) with the same angle speed. The torque of the shaft (14) is transmitted through the gear (15) to the feed roller (12) to drive the latter in the arrow direction in FIG. 3. At this time, the return roller (11) is in free condition in connection with the shaft (14) by the one way clutch (13) included therein whereby it is merely rotated through the band (2) depending upon the rotation of the feed roller (12) in the arrow direction as shown in FIG. 1. The differential reducing machine (20) is in free condition since the disc (23) is not engaged with the rocking member (30) as shown in FIG. 4 and the shaft (14) is rotated in the same angle speed with the pulley (10) whereby the disc (23) and the associated members are rotated as a one unit.

Thus, the band (2) stored in the chamber (3) is fed to the arch guide (4) and the leading end of the band (2) is reached through a guiding member in looped shape to a limit switch actuator (which is the same as a limit switch actuator (44) in FIG. 5) disposed under the slidable table. The outer peripheral surface of the feed roller (12) has low friction whereby the leading end of the band is contacted with the actuator to move it a slight distance. At this time, a slippage is caused between the contacting surface of the outer peripheral surface of the feed roller (12) and the band (2) because of the feeding resistance of the band which is rapidly increased, and it stops feeding of the band whereby any excessive feeding thereof can be prevented. The movement of the actuator for a specific distance produces a signal for stopping the motor.

In the conventional feeding apparatus, when the leading end of the band is contacted with the actuator, the rocker roller pushed to the feed roller (12) is disengaged (Japanese Unexamined Publication No. 64396/1977) or the feed roller (12) is stopped. In any case, a slight degree of time lag is produced until the feeding of the band is stopped. Accordingly, means for escaping a certain length of the band, which is fed within a short time, is needed.

In the present invention, the return roller (11) having the function as a rocker roller and the feed roller (12) having low friction are provided whereby the feeding of the band is automatically stopped due to the slipping phenomenon when the feeding resistance is rapidly increased and the excessive feeding of the band can be prevented. Then, the signal provided by the actuation of the actuator stops the motor (6) and the feed roller (12) is also stopped.

In order to draw back the band (2) whose leading end is gripped by a gripper (which is the same as the right gripper (48) in FIG. 5) disposed under the slide table (5), the motor (6) is reversely rotated to cause the reverse rotation of each of the pulley (9) and the pulley (10) at the same angle speed. The return roller (11) and the feed roller (12) are driven through the gear (15) and the one way clutch (13) in the counter-arrow direction by the rotation of the shaft (14) with the pulley (10) at the same angle speed without slippage of the friction plate (19) until the band drawn from the arch guide (4) is contact with the package. The band is pulled back under contacting with a substantially semicircular face of the return roller (11) having high friction to fittingly contact with a outer portion of the package in a short time (referred to as quick pulling back). At this time, the excessive length of the pulled band is stored in the chamber (3).

At the completion of the pulling operation, the pulling resistance is suddenly increased and accordingly, the friction plate (19) slips because of the lack of the torque for overcoming the increased resistance to cause the shaft (14) to stop. Then, the differential reducing machine (20) is actuated to perform strong pulling operation. The operation of the differential reducing machine will be illustrated.

When the disc (23) is in stopped condition and the movement of the eccentric body (24) is limited by the association of the slidable rolls (28) and the holes (27), the eccentric body (24) is vibrated by the rotary movement of the pulley (10). The vibration of the eccentric body (24) is transmitted through the engaging rolls (25) and (26) to the base body (21). The engaging roll (25) being in one piece with the eccentric body (24) is shifted between the engaging rolls (26) of the base body (21) whereby the rotation of the pulley (10) decelerates the rotation of the base body (21).

In this embodiment, fifteen of the engaging rolls are provided. Accordingly, when the pulley (10) is rotated fifteen times, the base body (21) is rotated once together with the shaft (14). When the load applied to the shaft (14) is higher than that of the disc (23), the shaft (14) is stopped and the disc (23) is rotated at the decelerated speed. That is, by differential function, when the load of the disc (23) is higher than that of the shaft, only the shaft (14) is decelerately rotated and when in reverse condition, only the disc (23) is decelerately rotated and either one is decelerately rotated (high torque) depending upon the differential of the loads applied to the both members. When no differential and loads are given whole of the differential reducing machine (20) is rotated as one unit for three members. The differential reducing machine used for the present invention can be a planetary gear system but not limited thereto.

In order to perform strong tightening operation, the solenoid (31) is actuated after completion of the quick pulling operation to stop the disc (23) by interlocking the stop tooth (29) with the engaging gear (22). Then, the decelerated rotational force having high torque is applied to the shaft (14) for the differential of the loads whereby the shaft is continuously rotated at low speed even though the friction plate (19) begins to slip to impart high torque to the return roller (11). The high torque is satisfactorily transmitted to the band by using the return roller (11) having high friction and by contacting the band (2) to the semicircular peripheral surface of the roller whereby the package can be wound tightly.

The tightening force can be adjusted in a predetermined value by adjusting the output of the motor (6) and the damping force for the disc (23).

As stated above, in the present invention, the pulley (9) having the friction plate (19) and the differential reducing machine (20) are mounted on the shaft (14) of the return roller (11) including the one way clutch and the feed roller (12) rotating with the shaft (14) is contacted with the return roller (11) under pressure to feed or pull the band depending upon the positive or reverse rotation under high speed which is transmitted to the pulley (9) and the shaft (14) is decelerated by the differential reducing machine at the completion of the quick pulling operation to give the strong tightening force. Accordingly, a plurality of the rocker rollers required in the conventional system are omitted and the operation for disengaging or contacting the rocker rollers to the feed roller is not required and a reliable operation can be obtained by providing a simple structure in which only the return roller is contacted with the feed roller. A low friction surface is formed on the outer peripheral part of the feed roller (12). Accordingly, when the leading end of the band is reached to the specific position during feeding the band, the band is prevented to feed in a slight time till the stop of the feed roller (12) by slippage between the feed roller (12) and the band even though the feed roller (12) and the return roller (11) are in contacting condition under pressure whereby the band can be prevented to run over from the arch guide or to bend due to the excessive feeding. A reliable tightening operation of the band can be performed under high torque by the association of the differential reducing machine (20) the feed roller (12) and the return roller (11) and also a time for tightening the band under the high torque can be shortened. The outer peripheral surface of the return roller (11) is formed by the element having high friction and the both of the rollers are disposed so as to contact the band with the semicircular surface of the return roller during tightening the band whereby the low speed under high torque provided by the differential reducing machine can be satisfactorily imparted to the band during tightening it.

What is claimed as new and desired to be secured by Letters Patent of the United States is:

1. A band feeding and tightening apparatus in a strapping machine which comprises a return roller having a high friction peripheral surface being disposed on a shaft, a feed roller having a low friction peripheral surface, said rollers contacting each other under pressure, a motor for driving said shaft and rotating said rollers, a one way clutch on said return roller and said shaft operable for placing said return roller in a free condition when said shaft is driven in one direction by said motor and for driving said return roller when said shaft is rotated in the other direction by said motor, a friction plate and a differential reducing machine fixed through said friction plate to said shaft of said return roller.

2. A band feeding and tightening apparatus according to claim 1 wherein the band is contacted to a substantially semicircular portion of the return roller when the band is tightened by the return roller and the feed roller.

* * * * *